US005710568A

United States Patent [19]

Shirazi et al.

[11] Patent Number: 5,710,568

[45] Date of Patent: Jan. 20, 1998

[54] ANTENNA AND METHOD OF MANUFACTURE OF A RADIO

[75] Inventors: Gadi Shirazi, Ramat-Gan; Uzi Zakai, Reuth; Shimon Medalsy, Rishon Le Zion, all of Israel

[73] Assignee: Motorola, Inc., Schaumburg, Ill.

[21] Appl. No.: 488,713

[22] Filed: Jun. 8, 1995

[30] Foreign Application Priority Data

Jun. 11, 1994 [GB] United Kingdom ..... 9411771

[51] Int. Cl.[6] ..... H01Q 1/04

[52] U.S. Cl. ..... 343/719; 343/846; 343/700 MS

[58] Field of Search ..... 343/700 MS, 702, 343/719, 846, 848, 872, 829, 830, 895; H01Q 1/36

[56] References Cited

U.S. PATENT DOCUMENTS

| | | | |
|---|---|---|---|
| 3,366,963 | 1/1968 | Goff | 343/895 |
| 4,479,130 | 10/1984 | Snyder | 343/815 |
| 4,700,194 | 10/1987 | Ogawa et al. | 343/700 MS |
| 4,835,541 | 5/1989 | Johnson et al. | 343/700 MS |
| 4,924,237 | 5/1990 | Honda et al. | 343/848 |
| 5,355,142 | 10/1994 | Marshall et al. | 343/700 MS |
| 5,365,246 | 11/1994 | Rasinger et al. | 343/830 |

FOREIGN PATENT DOCUMENTS

| | | |
|---|---|---|
| 0163454 A2 | 12/1985 | European Pat. Off. . |
| 937452 | 9/1963 | United Kingdom . |
| 2147744 | 5/1985 | United Kingdom . |
| 2198290 | 6/1988 | United Kingdom . |
| 2217112 | 10/1989 | United Kingdom . |

*Primary Examiner*—Donald T. Hajec
*Assistant Examiner*—Tan Ho
*Attorney, Agent, or Firm*—M. Mansour Ghomeshi

[57] ABSTRACT

An antenna is described having a generally elongate radiating part (10) and a reflective plane (11)juxtaposed and generally parallel to the elongate radiating part. The radiating part has a free end (15), a ground connection (13) remote from the free end and a feed connection (16) between the free end and the ground connection. The ground connection is mounted on the reflective plane (11), giving electrical ground connection and mechanical support. A method of manufacture of an antenna is also described involving breaking off an extension portion to suit the required frequency of operation.

7 Claims, 2 Drawing Sheets

ANTENNA AND METHOD OF MANUFACTURE OF A RADIO

FIELD OF THE INVENTION

This invention relates to an antenna, for example an antenna suitable for use underground. Separately and in addition the invention relates to a method of manufacture of a radio having an antenna.

BACKGROUND OF THE INVENTION

Irrigation systems are used today in places such as parks, municipal gardens, traffic islands, golf courses, etc. These systems provide remote control of a remote terminal unit (RTU) from a central unit over a radio or line link.

When using a radio method, the RTU contains the control unit the receiver and the antenna attached to the receiver front end (FE).

In locations where there is access to the power net, the RTU is placed in a box above ground level, generally in a central location where it can be connected to the net, and power lines run from it to control solenoids. The solenoids are located on water taps, and are used to control the flow of water in the pipes or to a sprinkler, to control the sprinkler's operation.

In places where there is no access to the power net, the RTU is placed in a box above ground level, generally in a central location, and powered by a battery. Most systems charge the battery with solar cells located nearby. Solenoids are installed in proximity to the RTU and connected to the RTU's power source. Hydraulic transfer tubes carry the commands from the solenoid to the water controls.

In the existing systems the RTU is placed above the ground, as are the receiver and the antenna. In most instances it is very easy to establish a radio frequency (R F) link between the central and the RTU within a known distance even if the antenna has a poor gain such as −15 dBi.

Using the RTU above ground level can cause various problems, such as: landscape pollution (in parks, gardens, etc.), interference with daily operations (on golf courses, parks, gardens, etc.), vulnerability to damage (caused by vandalism or incidental).

In military applications, it is known to provide an antenna buried underground for the activation of explosives using a radio signal transmitted from an aircraft. This is possible because there is a large angle of elevation between the radio signal and the earth's surface, so that attenuation of the radio signal by the ground is low. For this reason, the efficiency of the antenna used in such an application is not highly critical.

The inventors have identified a need for an improved efficiency antenna suitable for use underground.

SUMMARY OF THE INVENTION

According to the present invention an antenna is provided comprising a generally elongate radiating part and a reflective plane. The generally elongate radiating part has a free end, a ground connection remote from the free end and a feed connection between the free end and the ground connection. The reflective plane is juxtaposal and generally parallel to the elongate radiating part. The ground connection is mounted on the reflective plane thereby providing electrical ground connection and mechanical support to the elongate radiating part.

Tests have shown that the antenna according to the invention is very efficient even when buried underground, (for example up to a few meters in depth). Such an antenna enables, for the first time, the possibility of ground-to-ground communication via buried antennas.

The antenna is particularly suitable as a receive antenna in the range of 430 to 470 MHZ.

The elongate radiating part may be generally planar and may be mounted with its plane generally perpendicular to be reflective plane.

The ground connection may comprise at least one flange (and preferably two flanges) formed generally perpendicular to the plane of the radiating part.

With the above preferred feature the elongate radiating part can readily be formed as a single piece of metal sheet, therefore being inexpensive to manufacture.

Antennas need to be matched in dimension according to the radio circuitry to which they are connected (receiver or transmitter circuitry) and according to the operating frequencies of that circuitry. It is common to manufacture a single radio circuit with slight modifications for different markets or different countries depending on the exact frequencies allocated in different countries for operation of the equipment. It is expensive to design and manufacture separate antennas for similar items of equipment, differing only in their frequencies of operation.

According to a further aspect of the present invention, an antenna comprising a radiating part and an extension part, the extension part having a free end and the extension part extending from the radiating part and being connected to the radiating part by a web generally thinner than the radiating part and the extension part, for breaking off the extension part, where the web is located at a distance from the free end which is selected for alternatively matching the antenna to first radio circuitry if the extension part is present and second radio circuitry if the extension part is broken off, whereby the antenna is suited to different wavelengths of radiation when the extension part is not broken off and when it is broken off.

In this manner, a single antenna can be manufactured and very simply adapted from a longer wave length (for example) to a shorter wave length (for example) of operation.

The antenna could be a whip antenna or a telescopic antenna, for example circular in cross section. A removable cap could be provided to cover any rough edges formed by breaking off the extension part. In the preferred embodiment, the antenna is formed from flat metal sheet. In equipment where the antenna is entirely housed within a housing, it is of no consequence that the broken web may have rough edges or be untidy. Other technologies are suitable to this aspect of the invention, such as printed circuit board antennas.

In a further aspect of the invention, a method of manufacture of a radio is provided comprising the steps of providing radio circuitry, providing an antenna comprising a radiating part and an extension part, extending from the radiating part and connected to the radiating part by a web generally thinner than the radiating part and the extension part and selectively breaking off the extension part for matching the antenna to the radio circuitry.

It should be appreciated that the term "generally thinner web" includes the provision of through holes or indentations for weakening the joining of the radiating part and the extension part.

A preferred embodiment of the invention is now described by way of example, with reference to the drawings.

DETAILED DESCRIPTION OF THE DRAWINGS

Measurements show that when an antenna is buried underground, the RF signal suffers from an additional attenuation of 30 to 40 dB due to ground characteristics, when compared to an antenna operating above ground. In addition the resonant frequency of the antenna moves due to the ground conductivity and permittivity. The preferred embodiment of the present invention therefore seeks to provide an antenna of near to zero dB gain change when buried underground. It also seeks to be omni directional (a requirement generally in contradiction with the gain parameter). Low cost of manufacture and simple and reliable connection to a private circuit board are also important factors.

Figure 1:
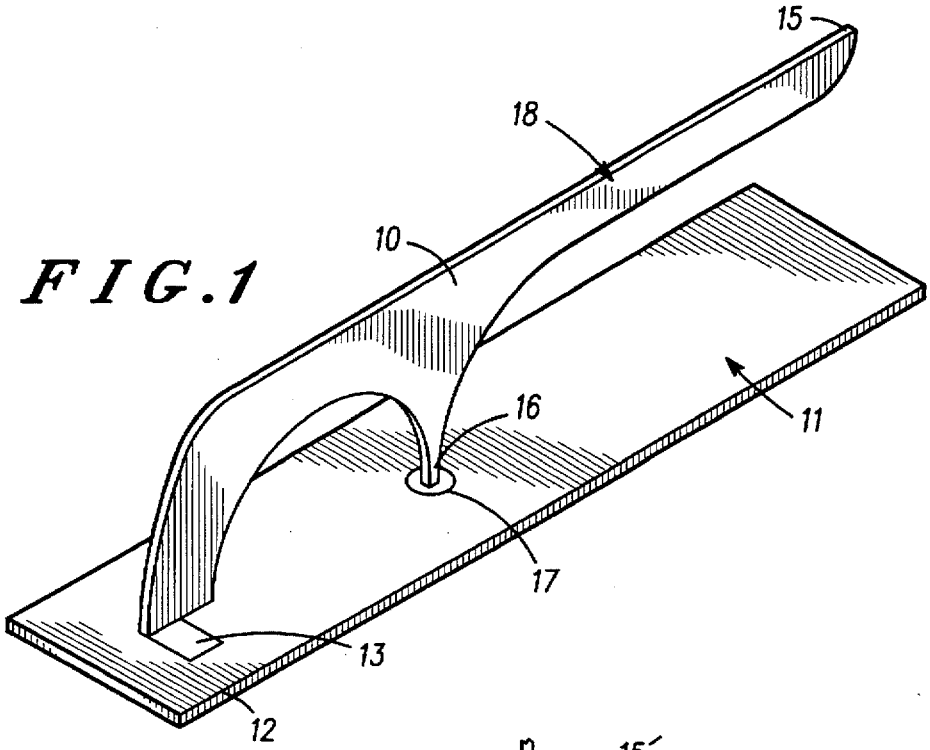
FIG. 1 is a stereoscopic view of the preferred embodiment of the antenna according to the invention.

Referring to FIG. 1, the antenna according to the preferred embodiment comprises a generally elongate part 10 made by pressing from sheet metal and a reflective part 11 comprising a printed circuit board (PCB) substrate 12 and conductive material 11 deposited thereon by known PCB manufacturing techniques. The generally elongate part 10 has a flange 13 perpendicular to the plane of the sheet metal elongate part 10 soldered to the surface of the PCB 12 by known techniques. Opposite to flange 13 and hidden from view in FIG. 1 is a second flange similarly soldered to the PCB. The generally elongate part 10 has a free end 15 and a centre feed connection 16 connected through the hole 17 in the reflective coating 11 and connected to a radio receiver circuit mounted on the opposite side of the PCB 12. Between the centre feed 16 and the free end 15 is an impedance matching part 18.

Figure 2:
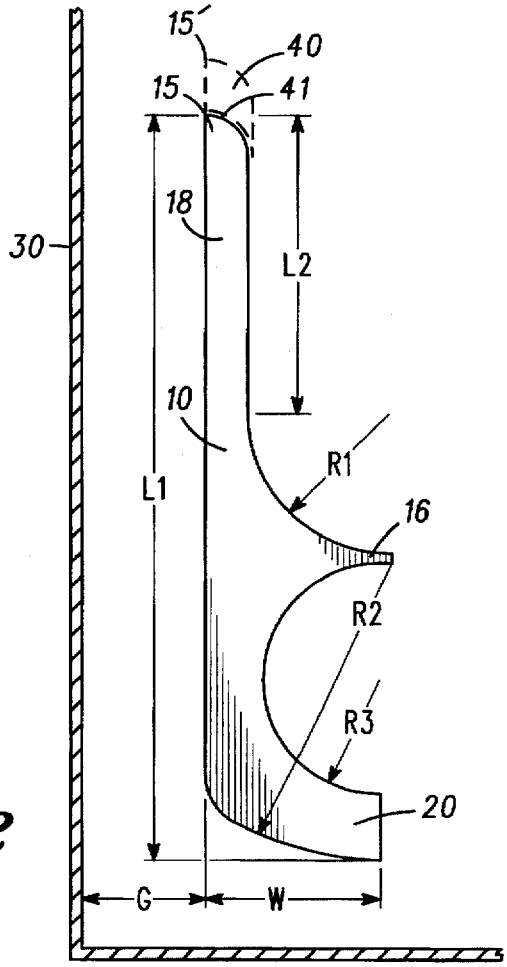
FIG. 2 is a side view of the antenna of the FIG. 1 shown mounted in its operative orientation and having an optional extension part.

Referring to FIG. 2, certain dimensions of the antenna are now described, illustrating the significance of various aspects of the shape. The elongate radiating part 10 has an overall length L1 of 173 millimeters. The impedance matching part has a length L2 from its free end to its narrowest point of 70 millimeters. The width of the impedance matching part 18 tapers from its free end to its lower end. This slight narrowing of the impedance matching part 18 is found to provide a flat impedance matching—i.e. 50 ohms impedance for different ground materials (sand, soil, different water contents). The lower end of the generally elongate part 10 has a ground connection 20 which is generally broad (15 millimeters), therefore giving a good ground connection and good mechanical support. The centre feed 16 is, by contrast, quite narrow (2 millimeters) therefore giving low capacitance and a good input to the receive circuitry. Other dimensions are as follows: width W=39.4 millimeters radius R1=32 millimeters; radius 2=69 millimeters; radius R3=27 millimeters. A housing is provided, preferably a plastic housing, which is separated from the elongate radiating portion 10 of the antenna by a gap G of preferably at least 10 millimeters and in the preferred embodiment at least 15 millimeters. This gap is maintained in the vertical dimension down the side of the elongate portion 10 and beneath the ground connection 20. A gap above the free end 15 of the elongate portion 10 is provided of preferably at least 40 millimeters. It will, of course, be appreciated that plastic support webs can be provided in this gap, but the gap is preferably free of metallic elements that would affect the radio characteristics of the antenna.

Also shown in FIG. 2 is an optional extension portion 40. This extension portion is formed in the same metal sheet as the elongate radiating portion 10 and has a web 41 connecting it to the impedance matching portion 18. When the extension portion 40 is present, the free end of the antenna is as indicated by numeral 15. The extension portion 40 can remain in place for operation at lower frequencies (for example). By snapping off the extension portion 40 which can be done manually due to the weakening in the area of web 41, the antenna is adapted for use at 430 to 470 MHZ (when buried underground).

The ground plane 11 (not shown in FIG. 2) improves the antenna's gain and stabilises the antenna's parameters against the changes in ground conductivity and permittivity.

Figure 3:
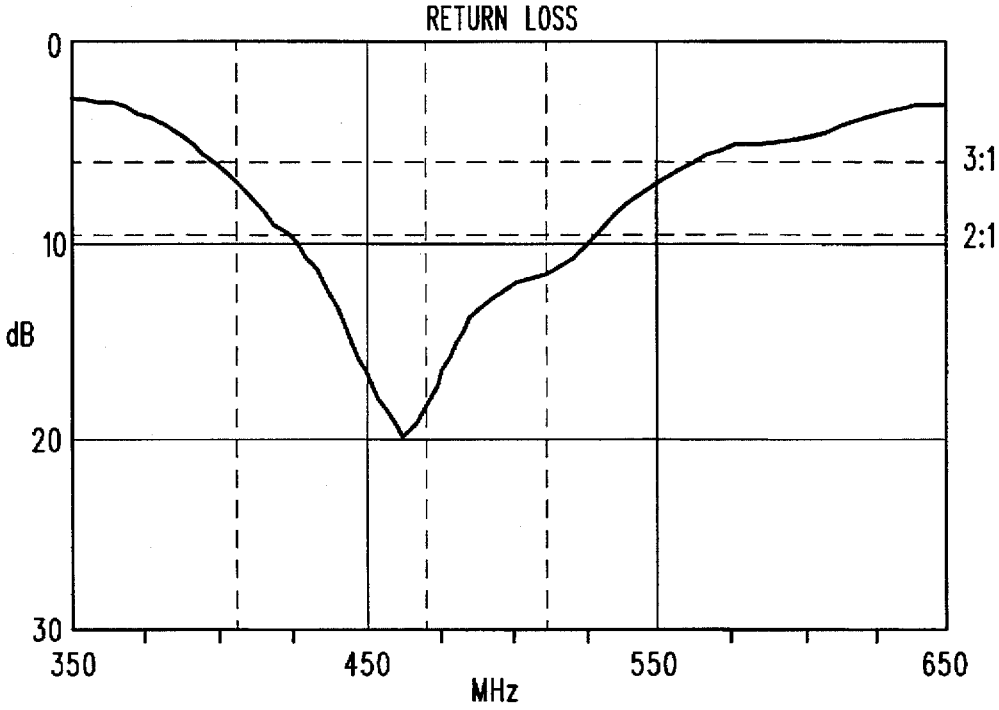
FIG. 3 is a graph of the measured returned loss of the antenna of FIG. 1 at different frequencies when buried underground.

FIG. 3 shows the return loss of the antenna when buried underground. The figure shows the return loss, that is to say the ratio of receive power to reflected power. A high ratio represents efficient receiving (low reflective power). The figure shows that the antenna is optimised for operation at about 455 MHZ.

Figure 4:
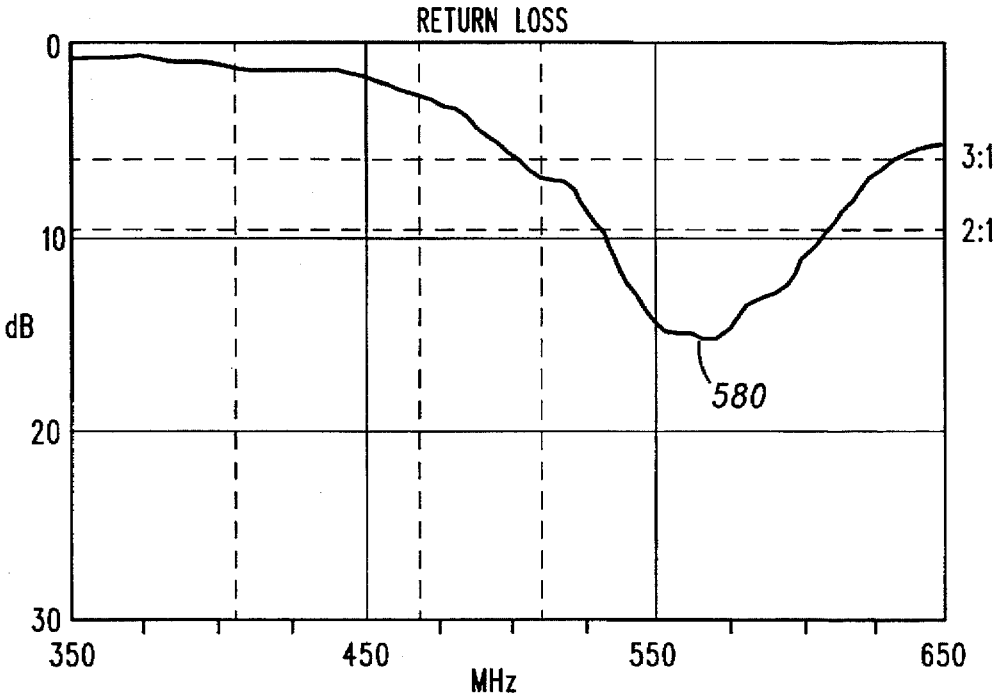
FIG. 4 is a graph of the measured returned loss of the antenna of FIG. 1 at different frequencies when operating in free space.

Referring to FIG. 4, the return loss for the same antenna is shown when operating above ground. It can be seen that the maximum loss ratio is about 16 dB at 580 MHZ.

The antenna described has the advantage of very high gain (5 dBi and 8 dB front to back). It can readily be used underground buried to a depth of 1 or 2 meters (for example) With such an antenna it is possible to bury an RTU underground and achieve a range of about 2.5 kilometers with a central transmitter output power of 2 watts. The antenna is robust and inexpensive.

We claim:

1. An underground antenna comprising:

a generally elongate and planar radiating part having a free end, a ground connection remote from the free end and a feed connection between the free end and the ground connection and connected to radio electronic circuitry having a given impedance and wherein the elongate radiating part comprises an elongate portion extending between the feed connection and the free end, which is dimensioned for impedance matching with the given impedance; and a reflective plane juxtaposed and generally parallel to the elongate radiating pan with the plane of the radiating part being generally perpendicular to the reflective plane, the ground connection being mounted on the reflective plane, thereby providing electrical ground connection and mechanical support to the elongate radiating part.

2. An antenna according to claim 1, wherein the elongate radiating part is formed as a single piece of metal sheet and further comprising an extension portion of metal sheet, extending from the radiating part to the free end and connected to the radiating part by a web generally thinner than the radiating part and the extension portion, for breaking off the radiating portion, whereby the antenna is suited to different wavelengths of radiation when the extension portion is not broken off and when it is broken off.

3. An antenna according to claim 1, wherein said antenna is mounted in a non-conductive housing where the housing is separated from the elongate radiating part on all sides by a distance of at least about one centimeter, whereby, when buried underground, the housing separates the elongate radiating part from surrounding ground material.

4. An antenna according to claim 1, operatively connected to radio electronic circuitry and buried underground.

5. An underground antenna comprising a radiating part and an extension part, the extension part having a free end and the extension part extending from the radiating part and being connected to the radiating part by a web generally thinner than the radiating part and the extension part, for breaking off the extension part, where the web is located at a distance from the free end which is selected for alternatively matching the antenna to first radio circuitry if the extension part is present and second radio circuitry if the extension part is broken off, whereby the antenna is suited to different wavelengths of radiation when the extension part is not broken off and when it is broken off.

6. An antenna according to claim 5, formed from flat metal sheet.

7. A method of manufacture of a radio comprising:

providing radio circuitry, providing an underground antenna comprising a radiating part and an extension part, extending from the radiating part and connected to the radiating part by a web generally thinner than the radiating part and the extension part, and selectively breaking off the extension part for matching the antenna to the radio circuitry.

* * * * *